United States Patent [19]

Ando et al.

[11] 4,368,353

[45] Jan. 11, 1983

[54] PRINTER HEAD FOR SERIAL DOT PRINTER

[75] Inventors: Hirokazu Ando; Yasuo Ohmori; Kazumasa Fukushima, all of Tokyo; Mitsuo Iwama; Tsunematsu Takahashi, both of Yokosuka, all of Japan

[73] Assignees: OKI Electric Industry Co., Ltd.; Nippon Telegraph & Telephone Public Corporation, both of Tokyo, Japan

[21] Appl. No.: 241,054

[22] Filed: Mar. 6, 1981

[30] Foreign Application Priority Data

Mar. 12, 1980 [JP] Japan ..... 55-30231

[51] Int. Cl.[3] ..... B41J 33/00; B41J 3/12

[52] U.S. Cl. ..... 178/30; 101/93.04

[58] Field of Search ..... 178/30; 400/124; 101/93.04, 93.05

[56] References Cited

U.S. PATENT DOCUMENTS

| | | | |
|---|---|---|---|
| 3,828,908 | 8/1974 | Schneider | 101/93.04 |
| 3,896,918 | 7/1975 | Schneider | 101/93.05 |
| 3,955,049 | 5/1976 | MacNeill et al. | 178/30 |
| 3,968,867 | 7/1976 | Stenudd | 101/93.04 |
| 4,167,343 | 9/1979 | Golobay | 101/93.05 |
| 4,222,674 | 9/1980 | Mori et al. | 101/93.05 |
| 4,225,250 | 9/1980 | Wagner et al. | 101/93.05 |
| 4,273,452 | 6/1981 | Honma | 101/93.05 |

OTHER PUBLICATIONS

Meier et al., "Matrix Printer Wire Actuator", *IBM Tech. Discl. Bull.*, vol. 20, No. 11 B, Apr. 1978, pp. 4748–4749.

*Primary Examiner*—Thomas A. Robinson

*Attorney, Agent, or Firm*—Armstrong, Nikaido, Marmelstein & Kubovcik

[57] ABSTRACT

A high operational speed print head for mosaic printing is provided which has a plurality of print needles positioned on a straight line, each being selectively driven toward a piece of paper through an ink ribbon. The printer head comprises a cylindrical permanent magnet ring magnetized in the axial direction; a circular bottom plate covering the bottom of the permanent magnet; and a plurality of electromagnets each having a center core and a coil wound around the core positioned on a circle on said bottom plate so as to be surrounded by the permanent ring magnet. A yoke provides a closed magnetic path with the permanent ring magnet, the bottom plate and each of the electromagnets. A plurality of moving bodies equal in number to the number of electromagnets are provided, each having at least an elongated armature overlying the core of the related electromagnet and composing a part of said closed magnetic path. A leaf spring supports the armature and is fixed to the yoke, and a print needle is mounted perpendicular to the elongated armature.

8 Claims, 15 Drawing Figures

Fig. 6A
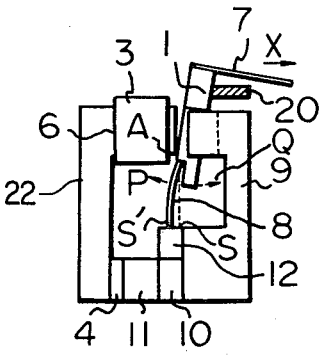
Fig. 6B
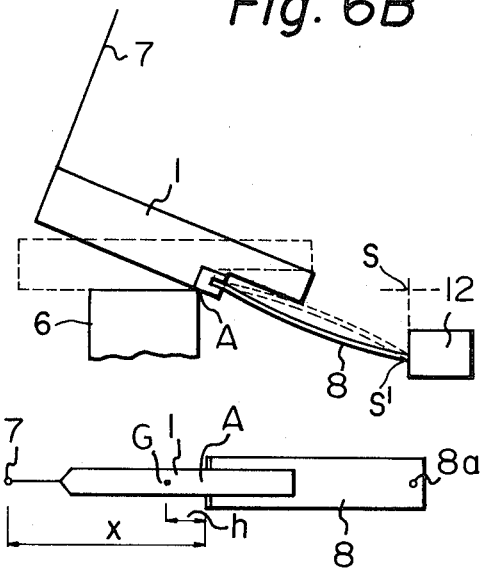
Fig. 6C
Fig. 7
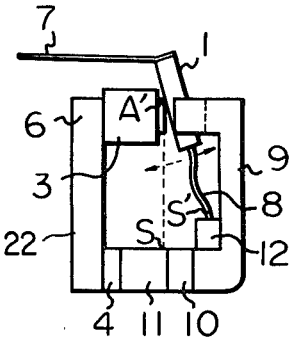
Fig. 8
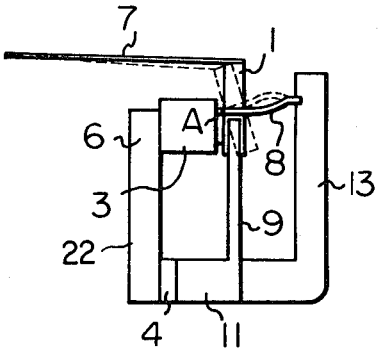

PRINTER HEAD FOR SERIAL DOT PRINTER

BACKGROUND OF THE INVENTION

The present invention relates to the improved structure of a print head for a dot matrix printer and, in particular, relates to the structure of the print head of a serial printer which can operate with improved high speed operation.

FIG. 1 shows the principle of dot matrix printing in a serial printer. A printer head 100 has seven needles for mosaic or dot matrix printing, and travels along a printing line in the direction of the arrow A. During travelling, needles are selectively driven to strike a paper through an ink ribbon and a desired pattern "A", "B", "C" or "D" is printed. The selection of needles is controlled by the content of an integrated circuit (IC) memory. When the size of a character to be printed is 2.67 mm×2.05 mm, a 7×5 dot matrix is large enough for printing a recognizable character.

One of the prior needle dot print heads for a dot printing process is shown in the U.S. Pat. No. 3,896,918, in which an electro magnetic drive structure for the operation of print needles of a mosaic printing head includes a pivotally mounted armature for each needle arranged along a circular arc. The construction includes a common yoke for all of the electro magnets which comprises two concentric cups or walls forming a single unit with cylindrical cores arranged at equal intervals along a circular arc parallel to the genatrix of the cup and located between the indivudual yoke cups. However, said prior print head has the disadvantages that the power consumption for driving the needles is large, the size of the apparatus is large, and the operational speed of the printer is rather slow. These disadvantages result mainly from the fact that a needle is driven by an electromagnet, and all the printing energy for striking a paper by a needle is given by said electromagnet.

Another print head for a serial dot matrix printer is shown in U.S. Pat. No. 4,225,250, in which a print needle is biased to a first position by a permanent magnet, and balanced at that first position with the force of a spring. When an electromagnet is energized, the flux of the permanent magnet is cancelled, and the needle is moved to a second position by the force of the spring. In this prior art device, the printing energy of the needle for striking the paper is produced by a spring, but not by an electromagnet. Therefore, this printer can be small in size, lower in power consumption, and operate with a relatively high printing speed. However, this printer head has the disadvantage that the printing speed is still not quick enough. In our experiments, this type of print head can operate with a printing speed of 1500 dots per second, but the operational speed of 3000 dots per second is desired.

U.S. Pat. No. 3,955,049 discloses another type of printer head, but the operational speed of this printer is still not quick enough.

The structure of the main part of a typical prior print head is shown in FIGS. 2A and 2B, in which FIG. 2A is a plan view and FIG. 2B is a side view, and only a single needle and the related magnet are shown for the sake of the simplicity of the drawing although an actual print head has a plurality of needles. In these figures, the yoke 5, the permanent magnet 4, the core 6, the electromagnet 3, and the armature 1 form the substantially closed magnetic path, and the armature which has a print needle 7 at the extreme end thereof is supported by the leaf spring 2, the end of which is fixed to the yoke 5 at the point P as shown in the drawings. When the electromagnet 3 is not energized, the armature 1 is attracted to the core 6 by the flux generated by the permanent magnet 4 in the closed magnetic path, and the spring 2 is curved and stores energy. Next, when the electromagnet is energized, the flux generated by the electromagnet cancels the flux of the permanent magnet 4, and thus, the net flux is not sufficient to attract the armature 1. Then, the armature 1 is released and leaves the top of the core 6, and the print needle 7 at the extreme end of the armature 1 is urged to move in the direction of the arrow, to strike the paper and print a dot. However, it should be noted that the armature 1, the spring 2 and the print needle 7 form a bulk moving body with a rotational center near the point P which is the contact point of the leaf spring 2 and the yoke 5, and that the length between the rotational center and the center of gravity $\tau$ of said moving body is rather long. In this situation, when the print needle 7 strikes a paper, the moving body still has energy, and the center of gravity of the moving body still moves by inertia, thus the moving body vibrates for a while after each strike action of the print needle. The vibration of the moving body causes the vibration of a print needle.

FIG. 3 shows the vibration of a print needle in a prior art printer head in which the horizontal axis shows time, and the vertical axis shows the displacement of the tip of a print needle. In FIG. 3, a print needle strikes a paper at the time T, but after striking it vibrates as shown in FIG. 3, and when the amplitude of the vibration is large, the needle strikes the paper a second time. This vibration of the print needle increases substantially the contact time of a print needle with a paper, and the energy stored in the spring or the moving body is released very slowly.

Accordingly, the power of impact or striking by a print needle on a paper is rather small as compared with the energy stored in the leaf spring or the kinetic energy of the moving body. The small impact power causes a reduction of the darkness of the printed dot, and a decrease in the printing speed, since the print needle restores slowly because of the small impact force. Further, the vibration of the spring causes the leaf unstable operation of the printer head.

That disadvantage of the vibration might be overcome by using a cross shaped spring instead of a leaf spring, so that the cross shaped spring does not become deformed by the reaction of the impact. However, the cross shaped spring is complicated in structure, as it has two leaf springs crossed with each other, and those two leaf springs must be fixed to the armature and the yoke. Thus, the manufacturing cost of the printer head with a cross shaped spring would be high.

SUMMARY OF THE INVENTION

It is an object, therefore, of the present invention to overcome the disadvantages and limitations of a prior serial printer head for dot matrix printing by providing a new and improved serial printer head.

It is also an object of the present invention to provide a printer head which operates with a higher printing speed than 1500 dots per second.

It is also an object of the present invention to provide a high speed serial printer head which is simple in structure.

The above and other objects are attained by a print head comprising; (a) a cylindrical permanent ring magnet which is axially magnetized; (b) a circular bottom plate covering the bottom of the permanent magnet; (c) a plurality of electromagnets each having a center core and a coil wound around the core positioned on a circle on the bottom plate so as to be surrounded by the permanent magnet; (d) yoke means for providing a substantially closed magnetic path with the permanent magnet, the bottom plate, and each electromagnet; and (e) a plurality of moving bodies equal in number to the number of electromagnets, having at least an elongated armature overlying the core of the related electromagnet and forming a part of the substantially closed magnetic path, a leaf spring supporting the armature which is fixed to the yoke means at the extreme end of the leaf spring, and a print needle mounted substantially perpendicular to the elongated armature at the extreme end thereof. The armature is pulled to the top of the related core in the absence of electric power to the coil to store the strain energy in the leaf spring, and the armature is released upon application of electric power to said coil to cause the print needle strike a paper; A cover plate covers the print head, and has a guide post for guiding the print needles so that the print needles are aligned on a straight line through the slit at the extreme end of the guide post; and each of the moving bodies is rotatably supported at the rotation center so that the armature rotates around the rotation center at one of the edges of the top of the core, and the mass of the moving body is distributed at both the sides of the rotation center.

BRIEF DESCRIPTION OF THE DRAWINGS

The foregoing and other objects, features, and attendant advantages of the present invention will be appreciated as the same become better understood by means of the following description and accompanying drawings wherein;

FIG. 6A shows a part of the structure of FIGS. 5A,5B, and 5C for the explanation of the printer head of FIGS., 5A, 5B and 5C, when the armature is completely released, FIG. 6B is the enlarged view of the main part of FIG. 6A, FIG. 6C is the plane view of a moving body shown in FIG. 6B, FIG. 7 is another embodiment of the printer head according to the present invention, when the armature is released FIG. 8 is still another embodiment of the print head according to the present invention.

DESCRIPTION OF THE PREFERRED EMBODIMENTS

Figure 4:
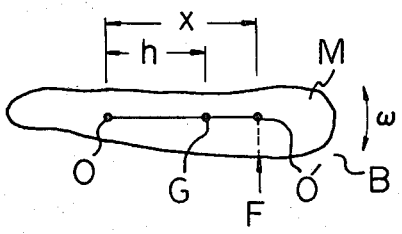
FIG. 4 is the explanatory drawing for the explanation of the theoretical principle of the present invention.

The theoretical principle of the present invention is first described in accordance with FIG. 4, in which a rigid moving body B has a center of gravity G, a mass M, and a rotational center or the rotational axis O. When the rigid body B is impacted by a force F at the impact point O', it is rotated around the rotational axis O with an angular velocity ($\omega$), and the reaction force $F_i$ applied to the rotational axis O is expressed in the following formula.

$$F_i = a(\omega)\,((J/Mh) - x)$$

where (a) is a constant, J is the moment of inertia of the body B, (h) is the distance between the center of gravity G and the rotational center O, and (x) is the length between the impact point O' (or the contact point of the needle and the armature) and the rotational center O. When $F_i = O$ is satisfied, the following formula is satisfied.

$$x = J/(Mh) \qquad (1)$$

When the formula (1) is satisfied, no reaction force is applied to the rotational axis O, and the body B is not vibrated by the impact force F. Therefore, we call that impact point O', the impact center when there is no reaction force. It should be appreciated that when the formula (1) is satisfied, the mass M is separated by the rotational center O, or the mass M is distributed to both the sides of the rotational center O.

Figure 5A:
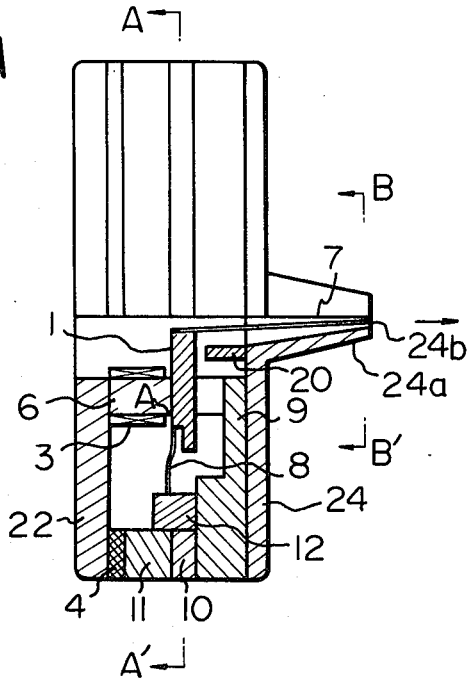
FIG. 5A shows the cross sectional view of the serial print head according to the present invention, when the armature is completely attracted.
Figure 5B:
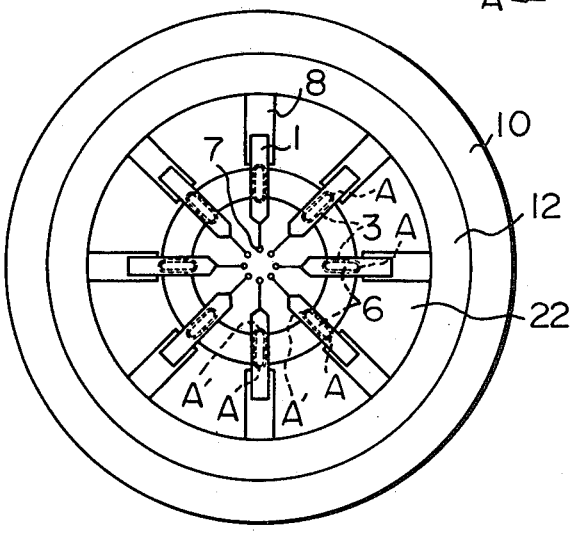
FIG. 5B is the cross sectional view at the line A-A' of FIG. 5A.
Figure 5C:
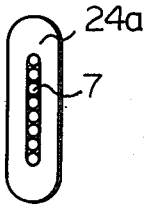
FIG. 5C is the cross sectional view at the line B-B' of FIG. 5A.

FIG. 5A shows the cross sectional view of the print head according to the present invention, FIG. 5B is the cross sectional view at the line A-A' of FIG. 5A, and FIG. 5C is the cross sectional view at the line B-B' of FIG. 5A. Also, the FIGS. 6A,6B and 6C are the explanatory drawings for the explanation of the operation of the printer head of FIGS. 5A,5B and 5C. In these figures, the reference numeral 22 is a circular bottom plate made of ferro-magnetic material, 4 is a cylindrical ring shaped permanent magnet secured on the bottom plate 22, 11 is a ring shaped first yoke, 10 is a ring shaped ferromagnetic spacer, and 9 is a second yoke with a small center hole. The members 9, 10 and 11 form a yoke means for providing a substantially closed magnetic path with the permanent magnet, the bottom plate, and each of said electromagnets. A plurality of electromagnets each having a core 6 and a coil 3 are positioned along a circle on the bottom plate 22 so as to be surrounded by the permanent magnet 4. A moving body with the armature 1, a print needle 7 fixed at the extreme end of the armature 1, and the leaf spring 8 is fixed to the armature support 12 which is ring shaped and is positioned on the inside wall of the yoke 11 and the spacer 10. The reference numeral 24 is a cover plate made of plastic with a post **24*a* at the center of the cover plate 24 for guiding the print needles, and an opening or a slit 24*b* at the top of the post 24*a*** serving as the outlet for the print needles.

It should be appreciated that one end of the print needles 7 are arranged on a circle as shown in FIG. 5B, and the other ends of the same are arranged linearly in the slit as shown in FIG. 5C. A ring shaped stopper 20 is provided at the center on the inside of the cover plate so that the stopper 20 restricts the stroke or the rotation of the armature 1.

The cross section of the core 6 is, preferably, elongated and is positioned radially on the bottom plate 20 so that the longer axis of the elongated cross section is in the radial direction as shown in FIG. 5B.

With the above configuration, it should be noted that a substantially closed magnetic path is provided from the permanent magnet 4, through the yoke 11, the spacer 10, the yoke 9, the armature 1, the core 6, the bottom plate 22, to the permanent magnet 4. Therefore, when the coil 3 of the electromagnet is not energized, the armature 1 is attracted or pulled to the top of the core 6 by the flux in the closed magnetic path induced by the permanent magnet 4, and the spring 8 is curved to store the potential energy or stress and the print needle 7 is withdrawn. FIG. 5A shows the situation in which the armature 1 is attracted to the core 6, and the print needle is withdrawn.

Next, when the coil 3 is energized, the flux induced in the core 6 by the electromagnet with the coil 3 cancels the flux in the core 6 induced by the permanent magnet 4, and the armature 1 is no longer attracted to the core 6. Then, the energy stored in the spring 8 is partially released, and the armature is rotated around the point A which is the external edge of the core 6 (see FIG. 6A and FIG. 6B). With the rotation of the armature 1, the print needle 7 travels outwardly as shown by the arrow X in FIG. 6A, and strikes a paper (not shown) to print a dot. A paper and/or the stopper 20 restricts the stroke or the rotation of the armature 1 so that the armature does not leave contact with the edge A. Therefore, the moving body with the armature 1, the spring 8 and the print needle 7 rotates around the axis A in the direction of the solid arrow P (see FIG. 6A) by releasing the spring 8, and the reaction force by the impact of the paper is applied in the opposite direction shown by the dotted arrow Q. In this case, when the relation of the formula (1) is satisfied, the reaction force by the impact of the paper applied to the rotational axis A is very small, and the spring and/or the moving body does not vibrate when the tip of the print needle 7 impacts upon a paper, and the impact power is very large. When the coil 3 is de-energized, the armature 1 is prompty restored to the original position.

FIG. 6B shows in detail the rotation of the armature 1. When the electromagnet is not energized, and the armature 1 is pulled to the top of the core 6, the armature 1 and the spring 8 are positioned in the dotted line position in FIG. 6B. When electric power is applied to the electromagnet and the armature 1 is released, the moving body rotates in the clockwise direction and is positioned as shown in the solid line position in FIG. 6B.

Figure 1:
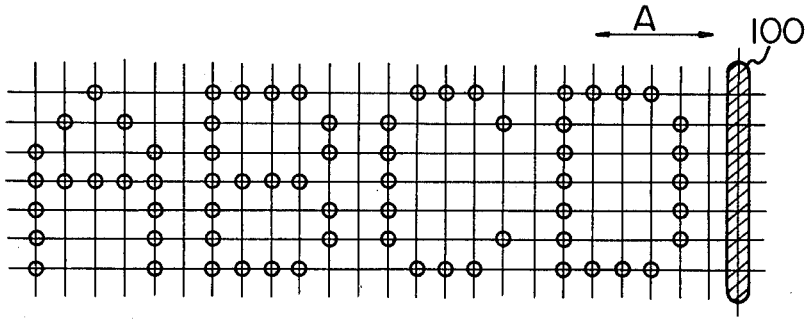
FIG. 1 shows a mosaic pattern for the explanation of the dot matrix printing of the present invention.
Figure 2A:
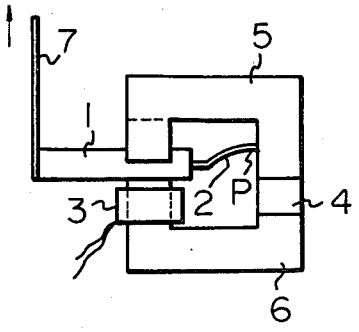
Fig. 2A PRIOR ART
FIGS. 2A and 2B show the structure of the prior serial print head when the armature is attracted and released.
Figure 2B:
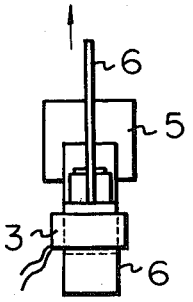
Fig. 2B PRIOR ART
Figure 3:
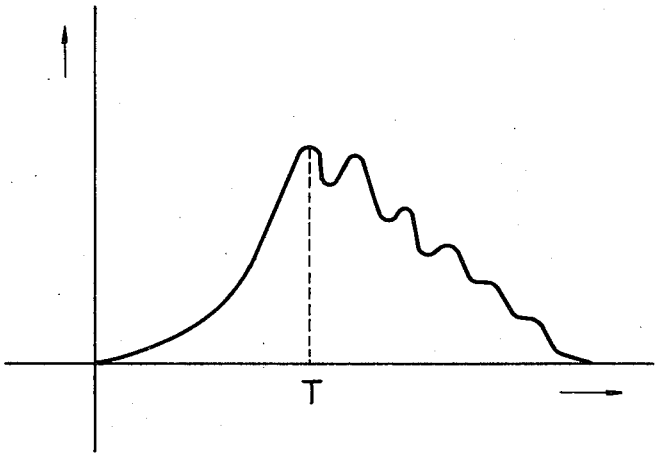
FIG. 3 shows the curve showing the relations between the time and the displacement in printing movement of a print needle of the prior art.

It should be appreciated in the present invention that the armature 1 does not leave contact with the core 6 even when the armature 1 is released but the armature 1 contacts to the core 6 at the axis A, and that the stress of the spring 8 is only partially released when the armature 1 is released. That is to say, the spring 8 is still stressed a little when the armature 1 is released. In comparison, with the prior art printer head of FIGS. 2A and 2B, a prior art armature 1 in FIG. 2A leaves the core completely when the armature 1 is released, and the stress of the spring is also completely released when the armature is released by applying electric power to the coil. Thus, the prior art armature rotates around the point P of FIG. 2A and the relationship of the formula (1) is not satisfied in the prior art.

In order to assure the above features, the moving body with the armature 1, the spring 8 and the needle 7 has a particular structure. The vertical view of the moving body is apparent from FIG. 6B, and the plan view of the moving body is shown in FIG. 6C. In those figures, 8*a* is a hole for fixing the moving body to the armature support 12, and the formula (1) is satisfied among the values x, h, G, M and J. Further, the armature 1 is fixed to the spring 8 at a point near the rotational axis A as shown in FIGS. 6B and 6C.

When the formula (1) is satisfied, it should be appreciated that the armature 1 has mass on both sides of the rotational axis A, or the mass of the armature is distributed at both the sides of the rotational center A.

Further, in order to assure that the armature 1 does not leave contact with core 6 at the axis A and the spring 8 is stressed even when released, the spring 8 is fixed to the armature support 12 at the point S' slightly displaced from the point S in the direction to the bottom plate 22, where the point S is the extension of the top surface of the core 6.

FIG. 7 shows another embodiment of the present printer head, in which the rotation center A' is at the inside edge of the core 6, while the rotation center A in FIGS. 5A and 5B is at the outside edge of the core 6. In the embodiment of FIG. 7, the spring 8 is fixed to the yoke at the point S' which is farther than the point S which is the extension of the top of the core 6 from the bottom plate.

FIG. 8 is another embodiment of the present printer head, in which the plate spring 8 is fixed approximately perpendicular to the armature 1, and the spring 8 is fixed to the armature 1 near the rotational center A. In FIG. 8, the reference numeral 13 is a cover made of non-magnetic material which supports the leaf spring 8.

Figure 9:
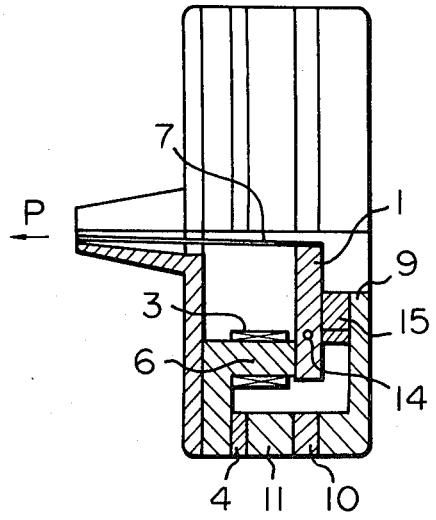
FIG. 9 is still another embodiment of the print head according to the present invention, when the armature is attracted.

FIG. 9 shows the structure of still another embodiment of the printer head of the present invention. In FIG. 9, the reference numeral 14 is a torsion spring which doubles as the axis of the rotation center of the armature 1, and 15 is the armature support made of ferro-magnetic material for fixing the torsion spring 14 and forms a part of the magnetic path. Of course, the torsion spring 14 is positioned so that the formula (1) is satisfied.

In FIG. 9, when the coil 3 is not energized, the magnetic flux generated by the permanent magnet 4 flows through the yoke 11, the spacer 10, the yoke 9, the armature support 15, the armature 1 and the core 6, and then, the armature 1 is attracted to the core 6. When the armature 1 is rotated by being attracted to the core 6, the torsion spring 14 is twisted and stores some energy. Next, when the coil 3 is energized, the magnetic flux generated by the coil 3 cancels the magnetic flux of the permanent magnet 4, and the armature 1 is not attracted to the core 6 anymore, and the torsion spring 14 is released. Then, the moving body with the print needle 7, the armature 1 and the torsion spring 14 rotates in a counter clockwise direction, and the print needle 7 is pushed to the left as shown by the arrow P of FIG. 7 and prints a dot on a paper. The torsion spring is completely released when the armature 1 is released, while the plate spring in previous embodiments is partially released. When the print needle 7 prints a dot, the print needle takes a reaction force from the paper, however, since the formula (1) is satisfied, the axis takes no reaction force, and the torsion spring 14 is not deformed by the reaction force. Thus, the impact force for striking a dot is relatively large. By de-energizing the coil 3 just after the impact by the print needle 7, the armature 1 is attracted again to the core 6, and the print needle 7 is restored.

It should be noted in FIG. 9 that the core 6 and the armature support 15 are staggered with respect of the center axis of the printer head, and therefore, the armature 1 attracts not only to the core 6 but also to the armature support 15. Therefore, the attraction force of the armature 1 is doubled as compared with the embodiment of FIGS. 5A, 5B and 5C.

Figure 10:
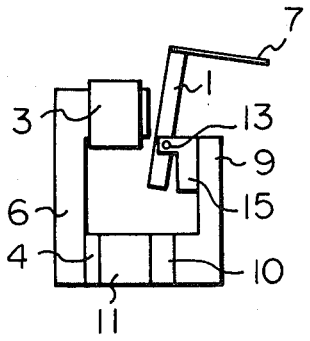
FIG. 10 is still another embodiment of the printer head according to the present invention, when the armature is released.

FIG. 10 shows the still another embodiment of the printer head according to the present invention, in which the relations between the core 6 and the armature support 15 are reversed as compared with the embodiment of FIG. 9, and the feature and the other structures of the embodiment of FIG. 10 are the same as those of the embodiment of FIG. 9.

As described above in detail, according to the present invention, an armature is supported so that the formula (1) is satisfied, and the mass of the moving body or the armature is distributed on both sides of the rotational center, or the rotational center separates the mass of the moving body. Therefore, the reaction force with impacting a paper by a print needle is not applied to the rotational center, and therefore, the substaitial contact time of the print needle to the paper is decreased, and the impact force by the print needle is increased. Thus, clearer printing is obtained with the improved printing speeds of up to 3000 dots per second. Further, since the present invention utilizes a single spring for each dot, instead of a cross spring which is complicated in structure, the manufacturing cost of the present printer head is cheaper than that having a cross spring.

From the foregoing it will now be apparent that a new and improved printer head has been found. It should be understood of course that the embodiments disclosed are merely illustrative and do not limit the scope of the invention. Reference should be made to the appended claims, therefore, rather than the specification as indicating the scope of the invention.

What is claimed is:

1. A printer head for a serial dot matrix printer comprising:

(a) a cylindrical permanent ring magnet which is axially magnetized, (b) a circular bottom plate covering the bottom of said permanent magnet, (c) a plurality of electromagnets each having a center core and a coil wound around the core positioned in a circle on said bottom plate so as to be surrounded by said permanent ring magnet, (d) a plurality of moving bodies equal in number to the number of said electromagnets, each moving body corresponding to one of said electromagnets and having at least an elongated armature overlying the core of said corresponding electromagnet, a leaf spring supporting said armature, and a print needle mounted substantially perpendicular to said elongated armature at an end thereof, (e) a yoke means for providing a substantially closed magnetic path with said permanent magnet, said bottom plate, each of said electromagnets, and each of said armatures, and supporting each of said plate springs at one end thereof, (f) each of said moving bodies being rotatably supported on one of the edges of the top of said corresponding core so that the armature rotates around a rotational center at said edge, and the rotating mass of the moving body is distributed on both sides of said center of rotation, with said leaf spring extending in the longitudinal direction of said elongated armature, the extreme end of said leaf spring being fixed to said yoke means at a point S' which is displaced from the extension S of the top of said core, wherein said armature is rotated about said edge on the top of said related core such that said armature is rotated towards said core in the absence of electric power to said coil thereby storing the stress in said spring, and said armature is released upon application of electric power to said coil such that said armature is rotated away from said core by the stress stored in said spring to cause said print needle to strike a paper, and (g) a cover plate covering the printer head, said cover plate having a guide post at the center of the same for guiding said print needles so that the print needles are aligned on a straight line through the slit at the extreme end of the guide post.

2. A printer head according to claim 1, wherein $x=J/(Mh)$, where x is the distance between the contact point of said print needle and said armature, and the rotational center, J is the moment of inertia of said moving body, M is the mass of said moving body, and h is the distance between the center of gravity of said moving body and said rotational center.

3. A printer head according to claim 1, wherein a ring-shaped stopper is fixed behind said cover plate for restricting the excess rotation of said moving bodies.

4. A printer head according to claim 1, wherein the rotational center of said moving body is the external edge of said corresponding core.

5. A printer head according to claim 1, wherein the rotational center of said moving body is the inner edge of said corresponding core.

6. A printer head according to claim 1, wherein said leaf spring extends in a direction perpendicular to said corresponding elongated armature, and the extreme end of said leaf spring is fixed to a cover means.

7. A printer head according to claim 1, wherein the extreme end of said leaf spring is fixed to said corresponding armature at a point close to the rotational center.

8. A printer head for a serial dot matrix printer comprising:

(a) a cylindrical permanent ring magnet which is axially magnetized, (b) a circular bottom plate covering the bottom of said permanent magnet, (c) a plurality of electromagnets each having a center core and a coil wound around the core positioned in a circle on said bottom plate so as to be surrounded by said permanent magnet, (d) a plurality of moving bodies equal in number to the number of said electromagnets, each moving body corresponding to one of said electromagnets and each having at least an elongated armature overlying the core of said corresponding electromagnet, a torsion spring passing laterally to said armature, and a print needle mounted substantially perpendicular to said elongated armature at the extreme end thereof, the mass of said moving body being distributed on both sides of said center of rotation, (e) yoke means for providing a substantially closed magnetic path with said permanent magnet, said bottom plate, each of said electromagnets, and each of said armatures, and supporting each of said torsion springs, (f) said armature being pulled to the top of said corresponding core in the absence of electric power to said coil to store stress in said torsion spring, and said armature being released upon application of electric power to said coil, wherein said print needle is moved to strike a paper by the release of the stress in said torsion spring, wherein $x=J/(Mh)$, where x is the distance between the contact point of said print needle and said armature, and said torsion spring, J is the moment of inertia of said moving body, M is the mass of said moving body, and h is the distance between the center of gravity of said moving body and said torsion spring, and (g) a cover plate covering said printer head, having a guide post for guiding said print needles such that the print needles are aligned on a straight line through the slit at the

* * * * *

UNITED STATES PATENT AND TRADEMARK OFFICE

CERTIFICATE OF CORRECTION

PATENT NO. : 4,368,353

DATED : January 11, 1983

INVENTOR(S) : HIROKAZU ANDO ET AL

It is certified that error appears in the above-identified patent and that said Letters Patent is hereby corrected as shown below:

Column 10, line 12, after "the" insert --- extreme end of the guide post. ---.

Signed and Sealed this

*Twelfth* Day of *June 1984*

[SEAL]

*Attest:*

GERALD J. MOSSINGHOFF

*Attesting Officer*

*Commissioner of Patents and Trademarks*